US008568051B2

(12) United States Patent
Burnett

(10) Patent No.: US 8,568,051 B2
(45) Date of Patent: Oct. 29, 2013

(54) PORTABLE WASHING DEVICE

(76) Inventor: Michael Burnett, Altamonte Springs, FL (US)

( * ) Notice: Subject to any disclaimer, the term of this patent is extended or adjusted under 35 U.S.C. 154(b) by 357 days.

(21) Appl. No.: 13/013,320

(22) Filed: Jan. 25, 2011

(65) Prior Publication Data

US 2012/0189372 A1 Jul. 26, 2012

(51) Int. Cl.
*A46B 11/06* (2006.01)

(52) U.S. Cl.
USPC ..... 401/289; 15/97.3; 15/29; 401/282

(58) Field of Classification Search
USPC ..... 401/282–291; 15/24, 28, 29, 49.1, 53.1, 15/97.1, 97.3, 103
See application file for complete search history.

(56) References Cited

U.S. PATENT DOCUMENTS

| | | | | | |
|---|---|---|---|---|---|
| 1,262,539 | A * | 4/1918 | Micka | 401/46 |
| 1,604,500 | A * | 10/1926 | Tannenbaum | 15/29 |
| 2,801,431 | A * | 8/1957 | Eastis | 15/29 |
| 3,409,924 | A * | 11/1968 | Slama | 15/24 |
| 3,619,074 | A * | 11/1971 | Morawski | 401/246 |
| 3,654,656 | A * | 4/1972 | Romagosa | 15/24 |
| 3,748,678 | A * | 7/1973 | Ballou | 15/24 |
| 3,989,391 | A * | 11/1976 | Thorner | 401/43 |
| 4,066,366 | A | 1/1978 | Reynolds | |
| 4,335,481 | A * | 6/1982 | Slayman | 15/29 |
| 4,780,992 | A * | 11/1988 | McKervey | 451/354 |
| 5,146,642 | A * | 9/1992 | Mank et al. | 15/24 |
| 5,769,324 | A | 6/1998 | Lenhart | |
| 6,227,745 | B1 * | 5/2001 | Privett | 401/289 |
| 6,257,786 | B1 * | 7/2001 | Thomas | 401/43 |
| 6,434,774 | B1 * | 8/2002 | Castellon | 15/50.1 |
| 6,748,619 | B2 * | 6/2004 | Quach | 15/29 |
| 6,786,431 | B2 * | 9/2004 | Song | 239/526 |
| 7,926,141 | B2 * | 4/2011 | Dayton et al. | 15/23 |
| 8,347,443 | B1 * | 1/2013 | Conrad | 15/24 |
| 2005/0031404 | A1 | 2/2005 | Tsai | |

* cited by examiner

*Primary Examiner* — David Walczak
*Assistant Examiner* — Jennifer C Chiang
(74) *Attorney, Agent, or Firm* — Daniel Law Offices, P.A.; Jason T. Daniel, Esq.

(57) ABSTRACT

A portable wash device includes an elongated shaft having a water inlet unit on one end and one or more rotating brush pads on the other end. The brush pads are rotated by a motor under instruction from a control handle. The device also includes a detergent reservoir for combining cleaning solution with water for projection by a nozzle, and an adjustable spray device for allowing a user to manually direct water to an object. A spray shield is located near to the brushes to prevent water and debris from impacting a user while operating the device.

15 Claims, 6 Drawing Sheets

PORTABLE WASHING DEVICE

BACKGROUND

Field of the Invention

The present invention relates generally to portable washing devices, and more particularly to a hand held washing device having motorized brush elements.

Traditional methods of washing objects such as vehicles and windows, for example, often require the use multiple items ranging from rags and brushes to soap and water. Once gathered, each of these items are utilized individually to perform the cleaning operation.

To this end, it is common for an object to be cleaned in an uneven fashion. For instance, areas of the object which are easily accessible (such as a car hood, for example) may receive adequate brush strokes, whereas another portion (such as a side panel or other hard to reach area) may only receive a light brushing. Owing to the fact that the brushes are applied to the object manually, the resulting appearance of the washed item is often directly proportional to the strength, endurance and reach of the individual doing the washing.

In light of the above, it would be beneficial to provide a single device capable of uniformly performing a wash operation without the drawbacks described above.

SUMMARY OF THE INVENTION

The present invention is directed to a portable wash device having motorized brush elements. One embodiment of the present invention can include an elongated shaft having a water inlet unit on one end and one or more motorized brush pads on the other. Additionally, the device can include an integrated control handle for operating the functions of the unit, and a detergent reservoir for storing and combining cleaning solution with water.

In one embodiment, the device can direct a spray of fluid to the area of an object being cleaned by the brush pads and can also include an adjustable spray device for allowing a user to manually direct water to the object. Another embodiment of the present invention can include a spray shield to prevent water and debris from impacting a user while operating the device.

BRIEF DESCRIPTION OF THE DRAWINGS

Presently preferred embodiments are shown in the drawings. It should be appreciated, however, that the invention is not limited to the precise arrangements and instrumentalities shown.

DETAILED DESCRIPTION OF THE INVENTION

While the specification concludes with claims defining the features of the invention that are regarded as novel, it is believed that the invention will be better understood from a consideration of the description in conjunction with the drawings. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the inventive arrangements in virtually any appropriately detailed structure. Further, the terms and phrases used herein are not intended to be limiting but rather to provide an understandable description of the invention.

Figure 1:
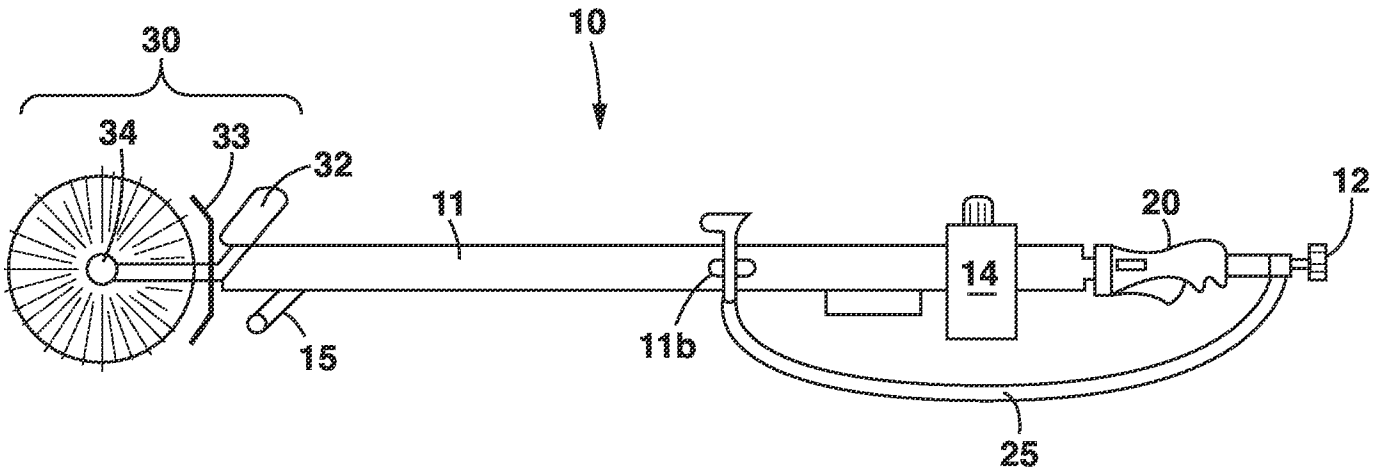
FIG. 1 is a side elevation of a portable wash device that is useful for understanding the inventive concepts disclosed herein.
Figure 2:
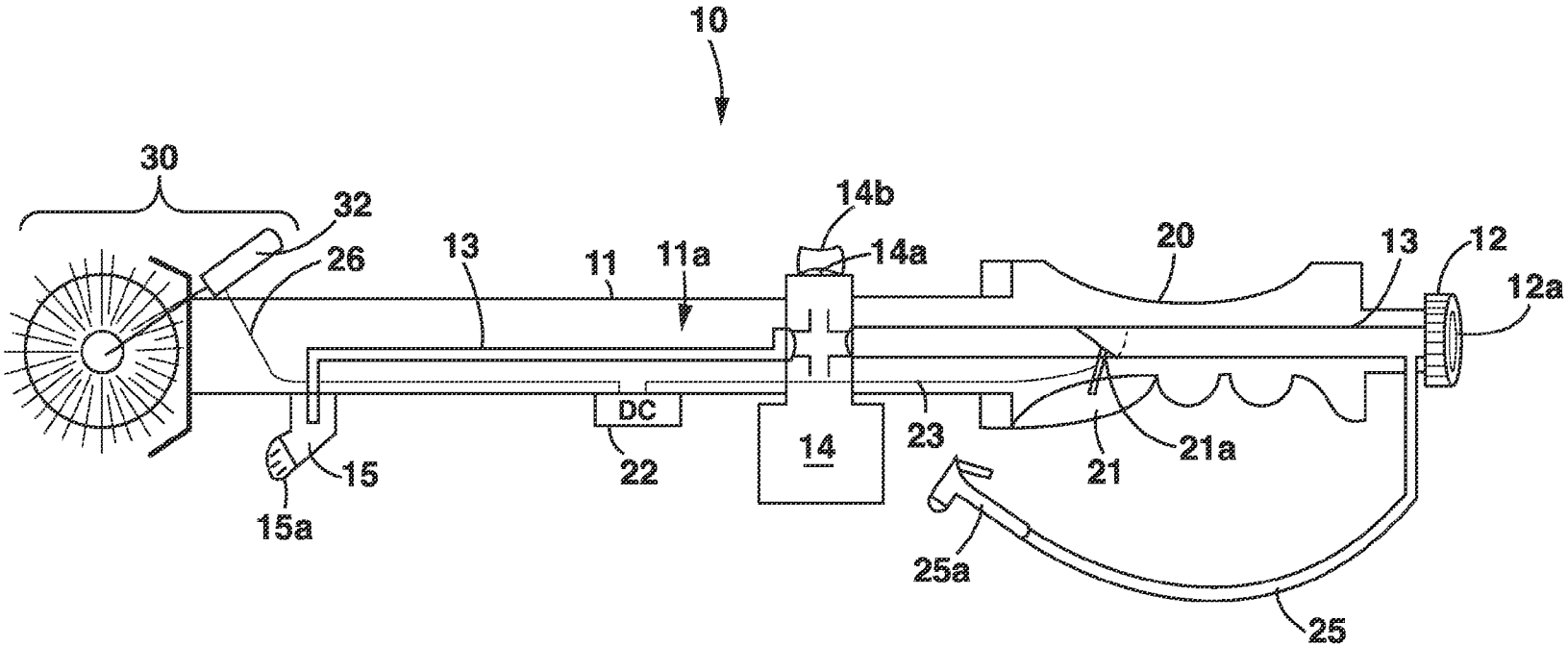
FIG. 2 is a side view of a portable wash device according to one embodiment of the invention.
Figure 3:
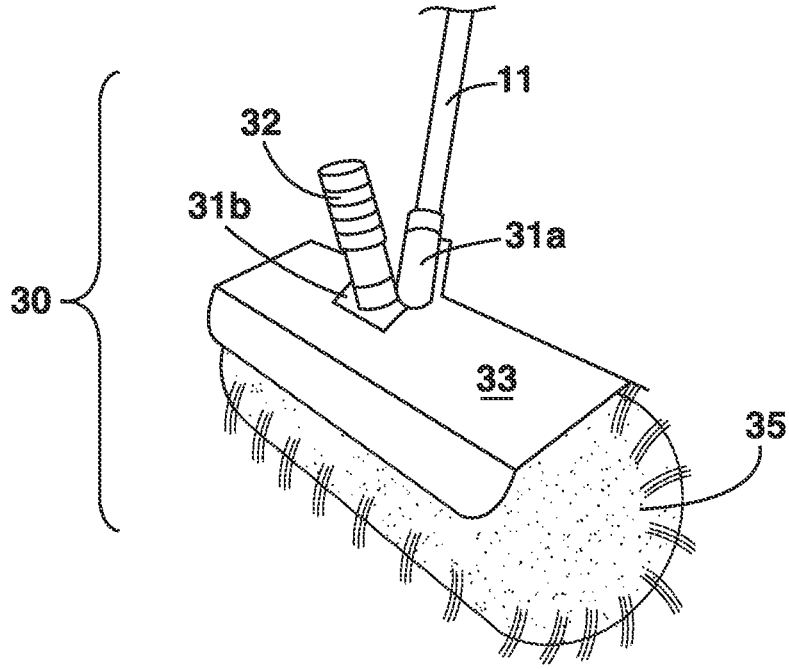
FIG. 3 is a perspective view of the cleaning unit of the portable wash device according to one embodiment of the invention.

FIGS. 1 and 2 illustrate one embodiment of a portable wash device 10 that is useful for understanding the inventive concepts disclosed herein. As shown, device 10 can include a wand 11, a water inlet unit 12, a detergent reservoir 14, a control handle 20, a rinse hose 25, and a motorized cleaning unit 30.

The wand 11 can act as an elongated shaft for facilitating manual gripping and manipulation of the device 10. In one preferred embodiment, the wand 11 can include a hollow tubular member such as aluminum, for example, having an internal cavity 11*a* running the length thereof. Of course, other materials are also contemplated.

A water inlet unit 12 can function as a means for allowing water to be introduced to the device. To this end, the inlet unit 12 can be positioned on one end of the wand 11 and can be configured to mate with a conventional water hose (not shown) via the plurality of threaded grooves 12*a* imprinted on an inside portion thereof. In one preferred embodiment, the device can be connected to a water hose that carries a supply of pressurized water from a domestic water source. However, other uses and connections are also contemplated.

The internal liquid supply line 13 can act to transfer water from the inlet unit 12, through the detergent reservoir 14 and into a spray nozzle 15 positioned at the opposite end of the wand. As shown, the liquid supply line 13 can be positioned within the internal cavity 11*a* of the wand 11 so as to be invisible to a user. In one embodiment, the liquid supply line 13 can be constructed from a synthetic rubber hose, however other materials are also contemplated.

The detergent reservoir 14 can be secured to the shaft wand 11 and connected to the liquid supply line 13 as described above. The detergent reservoir can function as a proportioning system capable of receiving any number of commercially available cleaning solutions via the opening 14*a* and can act to store and mix the cleaning solutions with water supplied from the supply line 13. Once mixed, the resulting fluid can be sent to the spray nozzle 15 via the supply line 13. Additionally, the detergent reservoir 14 can include an integrated control unit 14*b* for allowing a user to select a desired ratio of cleaning solution and water. As reservoirs/proportioning systems of this type and their associated components are extremely well known in the art, no further description will be provided.

The spray nozzle 15 can be positioned near the bottom edge of the wand 11 in order to supply the fluid from the reservoir to the brushes of the cleaning unit 30. To this end, the spray nozzle can act to force the fluid through a series of openings 15*a* so as to create a uniform stream of water in a desired direction.

The control handle 20 can act as a grip and a means for controlling the functionality of the device 10. In one preferred embodiment, the control handle can be positioned along the wand 11 in a location proximate to the inlet unit 12. As shown, the control handle 20 can include a trigger 21 connecting to an internal mechanism 21*a* (such as a variable valve, for example) capable of regulating the amount of water flowing through the liquid supply line 13. Additionally, the trigger 21 can act to control the operation of the motorized cleaning unit 30 by acting as a switch for allowing power to be transferred from the power source 22 to the motor of the motorized cleaning unit 30 via the motor wires 23 and 26.

The power source 22 can include one or more individual batteries or battery packs fabricated to produce a voltage sufficient to operate the motorized cleaning unit 30. Although described above as controlling both the water supply and the power to the motorized cleaning unit, in one alternate embodiment, the handle 20 can also include a conventional on/off switch (not shown) for controlling the operation of the motor separate from that of the water.

The rinse hose 25 and the adjustable spray nozzle 25*a* can allow a user to manually direct fresh water from the inlet unit 12 onto the object being washed. As shown, one end of the rinse hose 25 can be connected to the liquid supply line 13 in a position between the inlet unit 12 and the control handle 20; however other positions are also contemplated. This connection can preferably be in the form of a three way valve such that water from the inlet unit 12 can flow to both the detergent reservoir 14 and the rinse hose 25 simultaneously. In another embodiment, the device 10 can also include a clip 11*b* for securing the spray nozzle 25*a* to the wand 11.

FIGS. 3-6 illustrate one embodiment of a cleaning unit 30 of the device that includes a frame 31, a motor 32, a spray shield 33, a drive shaft 34 and one or more rotating brush pads 35.

Figure 4:
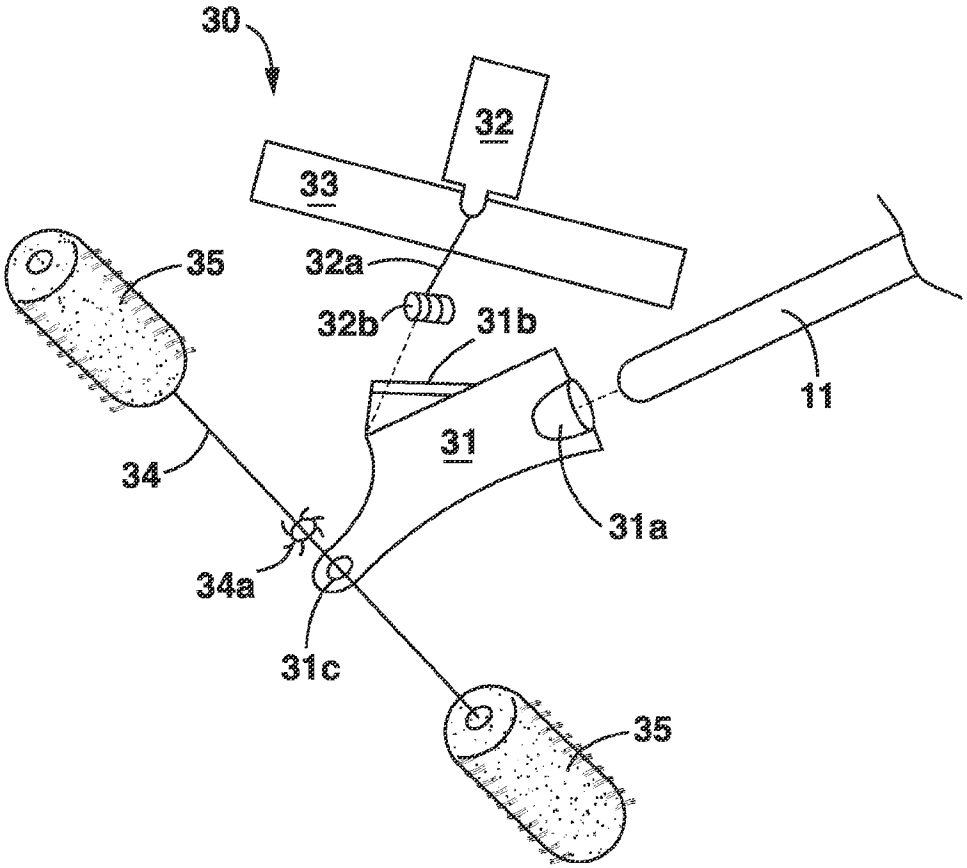
FIG. 4 is an exploded parts view of the cleaning unit of the portable wash device according to one embodiment of the invention.
Figure 5:
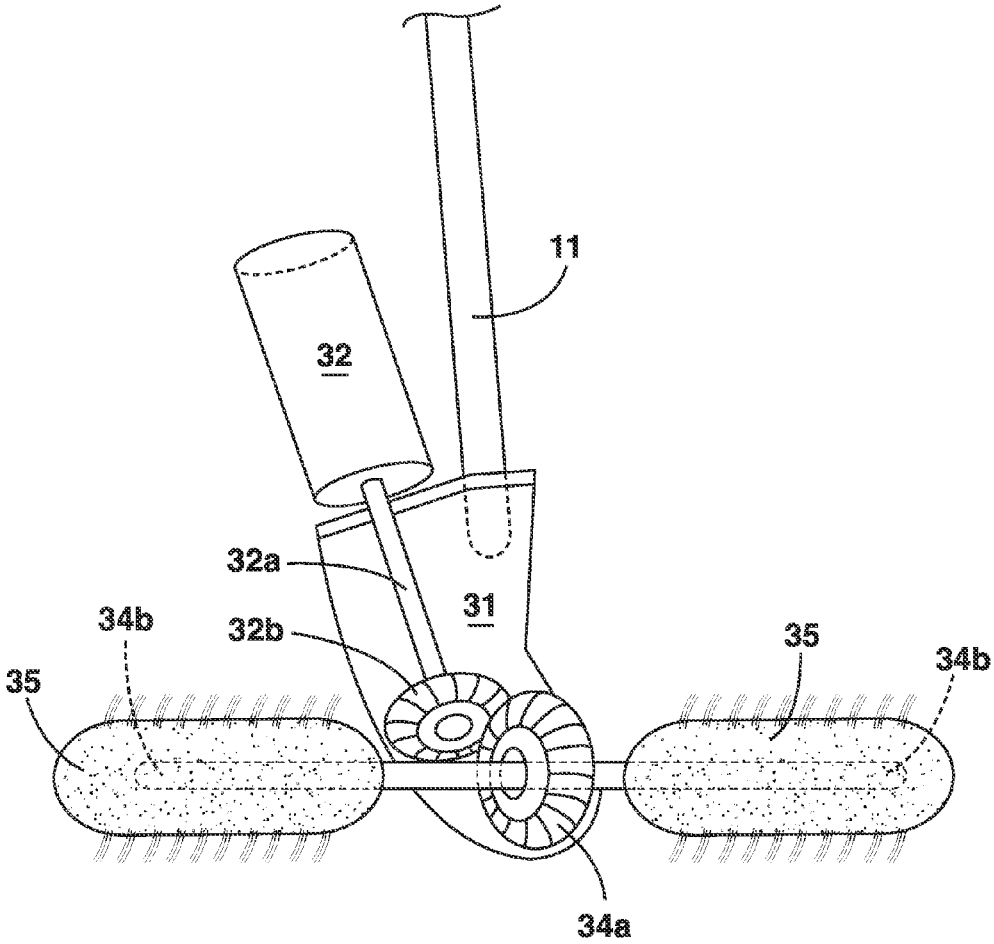
FIG. 5 is a cutout view of the cleaning unit of the portable wash device according to one embodiment of the invention.

As shown in FIG. 4, the frame 31 can act to securely position each element of the cleaning unit to the end of the wand 11. To this end, the frame 31 can include a pocket 31*a* for securely positioning the bottom end of the wand 11 to the frame. Additionally, the frame can include a mounting plate 31*b* for receiving the motor 32 and an opening 31*c* for receiving the drive shaft 34. In one preferred embodiment, the frame 31 can be constructed from a rigid material such as steel or cast aluminum having excellent durability and tensile strength, however other materials are also contemplated.

The motor 32 can act to provide the rotational force to spin the brush pads 35, and can be secured to the mounting plate 31*b* via any number of known attachment means such as bolts, lugs, magnetic elements and/or general compression fittings. In one preferred embodiment, the motor 32 can include a conventional 12.0 volt electrical Gearhead DC motor, having an integrated rod 32*a* and a gear 32*b* connected thereto. Moreover, it is preferred that the motor be positioned along the top portion of the frame 31 adjacent to the wand 11 so as to distribute the weight of the motor along the central axis of the device.

Although described above as including a specific motor and gear configuration, one of skill in the art will recognize that any number of different size motors, positional arrangements and gear types (such as a bevel or a worm and roller gear, for example) can be utilized without deviating from the scope and spirit of the inventive concepts disclosed herein.

The spray shield 33 can act to prevent water and debris from impacting a user while operating the device. Accordingly, the spray shield can preferably include an elongated panel having a length approximating that of the brush pads 35 that is constructed from a rigid material such as metal or hardened plastic. As shown, the shield can be connected to the frame 31 parallel to the brush pads in order to provide protection to the user.

The drive shaft 34 can act to transfer the rotational force of the motor 32 to the brush pads 35. Accordingly, the drive shaft 34 can include an elongated shaft/cylinder having a receiving gear 34*a* configured to mate with the motor gear 32*b* (see FIG. 5). In one preferred embodiment, the drive shaft 34 can include an elongated steel rod securely positioned within opening 31*c* via a bearing (not shown) or other such device capable of securely orienting the drive shaft at a perpendicular angle to the motor rod 32*a* while still allowing the drive shaft to rotate. In this regard, the receiving gear 34*a* can mate with the motor gear 32*b* in order to transfer the rotational force of the motor 32 to the brush pads. In one preferred embodiment, gears 34*a* and 32*b* can be constructed from hardened steel or cast aluminum and can engage along the central axis of the device; however, other materials and placements are also contemplated.

Figure 6:
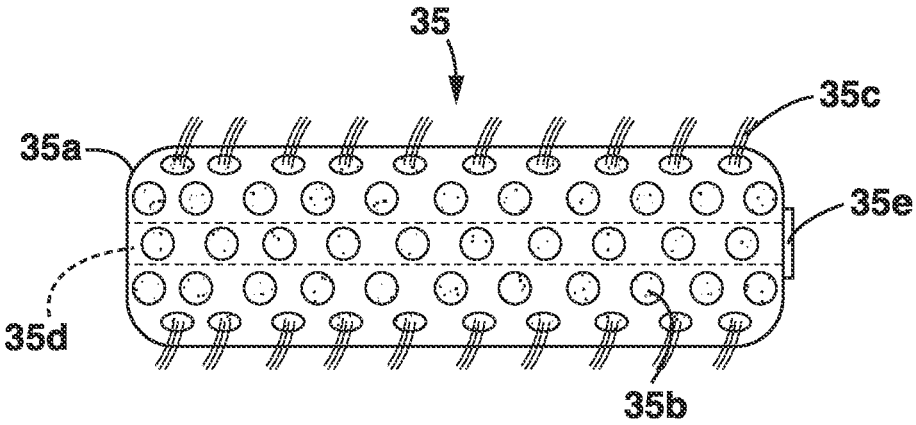
FIG. 6 is a front view of a brush pad for use with the portable wash device according to one embodiment of the invention.

FIG. 6 illustrates one embodiment of a brush pad 35 that includes an elongated circular member 35*a* having a plurality of holes 35*b* with bristles 35*c* extending therefrom. The brush pad can also include a channel 35*d* for receiving one end of the drive shaft 34*b* and can further include securing hardware 35*e* for ensuring the pad and drive shaft remain securely connected.

In one preferred embodiment, the circular member 35*a* can comprise a wood, plastic or PVC base and the plurality of bristles can include elongated strands of soft plastic, rubber or fabric, however, other materials are also contemplated.

As described herein, one or more elements of the portable wash device 10 can be secured together utilizing any number of known attachment means such as, for example, screws, glue, compression fittings and welds, among others. Moreover, although the above embodiments have been described as including separate individual elements, the inventive concepts disclosed herein are not so limiting. To this end, one of skill in the art will recognize that one or more individual elements may be formed together as a single component, either through manufacturing processes, such as welding, casting, or molding, or through the use of a singular piece of material milled or machined with the aforementioned components forming identifiable sections thereof.

In operation, a user can employ the device 10 to perform a cleaning operation in which the mechanical rotation of the brush pads and direct application of a detergent solution results in a uniform and superior result without regard to the strength and endurance of the user.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. A portable wash device, comprising:

an elongated wand having a cavernous interior;

an inlet unit disposed on a first end of the wand, said inlet unit being configured to receive a first fluid under pressure;

a proportioning unit communicating with the inlet unit, said proportioning unit being configured to combine the first fluid with a second fluid;

a spray nozzle configured to discharge the combination of fluids, said spray nozzle being secured to a bottom periphery of the elongated wand and communicating with the proportioning unit;

a frame having a first end that is disposed on a second end of the elongated wand and extending longitudinally outward therefrom along a central axis of the wand;

an elongated cylindrical drive shaft having a middle section that is rotatably coupled to a second end of the frame, said drive shaft being secured and maintained by the frame at a perpendicular orientation to the elongated wand;

a pair of elongated generally tubular brush pads that are disposed along the drive shaft and extend from the middle section of the drive shaft to a first and second end thereof, respectively;

a motor that is secured to the frame, said motor being configured to apply a rotational force to the perpendicularly oriented drive shaft; and a control unit configured to regulate the operation of the spray nozzle and the motor, wherein said control unit includes a handle for manual gripping.

2. The portable wash device of claim 1, further comprising:

a supply line configured to connect each of said inlet unit, proportioning device and spray nozzle, said supply line being located within the cavernous interior of the elongated wand.

3. The portable wash device of claim 2, further comprising:

a rinse unit configured to manually expel the first fluid from the device, said rinse unit including a rinse hose and a manual spray nozzle.

4. The portable wash device of claim 3, wherein said rinse hose is connected to the internal supply line on a first end and the manual spray nozzle on a second end.

5. The portable wash device of claim 4, further comprising:

a clip for securing the manual spray nozzle to the elongated wand.

6. The portable wash device of claim 1, further comprising:

a shield having a parallel relationship with the perpendicularly oriented drive shaft, said shield including a length and a width that is approximate to a length and a width of the pair of elongated brush pads.

7. The portable wash device of claim 1, wherein each of said brush pads includes a hardened base and a plurality of bristles extending outward therefrom.

8. The portable wash device of claim 1, wherein said inlet unit is configured to be secured to a conventional garden hose.

9. The portable wash device of claim 1, wherein said proportioning unit is configured to store the second fluid.

10. The portable wash device of claim 9, wherein said proportioning unit further includes an adjustment unit configured to output a desired ratio of first and second fluids.

11. The portable wash device of claim 1, further comprising:

a power source configured to provide power to the motor.

12. The portable wash device of claim 1, wherein said motor is positioned along the central axis of the elongated wand.

13. A portable wash device, comprising:

an elongated wand;

means for receiving a first fluid;

means for storing a second fluid;

means for combining the first fluid with the second fluid;

means for discharging the combination of fluids;

means for housing and rotating a plurality of bristles in a direction that is perpendicular to a direction of the elongated wand;

means for controlling each of the means for discharging and means for rotating a plurality of bristles; and means for discharging the first fluid.

14. The device of claim 4, wherein the rinse unit further includes a valve that is interposed between the rinse hose and the internal supply line, said valve functioning to allow the device to simultaneously discharge the first fluid from the manual spray nozzle and the combination of fluids from the spray nozzle that is located on the bottom periphery of the elongated wand.

15. The portable wash device of claim 1, wherein the motor is positioned along the central axis of the elongated wand at a perpendicular orientation to the elongated shaft.

* * * * *